US005518425A

United States Patent [19]

Tsai

[11] Patent Number: 5,518,425

[45] Date of Patent: May 21, 1996

[54] DECORATIVE BULB SOCKET

[76] Inventor: George Tsai, 7 Fl., No. 147, Sec. 4, Jen-Ai Rd., Taipei, Taiwan

[21] Appl. No.: 346,531

[22] Filed: Nov. 29, 1994

[51] Int. Cl.[6] ..... H01R 17/00

[52] U.S. Cl. ..... 439/660; 439/375; 439/419; 439/696; 439/617

[58] Field of Search ..... 439/375, 419, 439/596, 602, 611, 617, 660, 696

[56] References Cited

U.S. PATENT DOCUMENTS

| | | | |
|---|---|---|---|
| 3,371,306 | 2/1968 | Moranduzzo | 439/602 |
| 4,660,906 | 4/1987 | Haraden | 439/611 |
| 5,350,315 | 9/1994 | Cheng et al. | 439/419 |
| 5,380,215 | 1/1995 | Huang | 439/419 |

*Primary Examiner*—P. Austin Bradley
*Assistant Examiner*—Jill DeMello
*Attorney, Agent, or Firm*—Webb Ziesenheim Bruening Logsdon Orkin & Hanson

[57] ABSTRACT

A socket assembly which includes a socket, an annular positioner and two leaf conductors. The socket includes two slots defined in a bottom and a groove defined in an internal surface. The annular positioner includes an opening defined therein and a ridge formed on an external surface. The ridge is received in the groove when the annular positioner is received in the socket to restrain rotation of the annular positioner with respect to the socket. The leaf conductors are inserted through the slots. One of the leaf conductors includes an upper tip inserted through the opening to be retained between the socket and the annular positioner to prevent bending thereof and engagement between the leaf conductors when a bulb is received in the socket.

16 Claims, 2 Drawing Sheets

DECORATIVE BULB SOCKET

FIELD OF THE INVENTION

This invention relates to a decorative bulb socket and, more particularly, to a positioner for retaining one of two leaf conductors in the decorative bulb socket.

RELATED PRIOR ART

Decorative light strings are often used in holidays or festivals. Each of the light strings includes a plurality of bulbs engageable with a corresponding number of sockets coupled with one another by means of a pair of wires. A first leaf conductor and a second leaf conductor are insertable through each of the sockets. The first leaf conductor is retained parallel to an inner surface of the socket while the second leaf conductor is bent. When one of the decorative bulbs is engaged with a corresponding one of the sockets, a negative electrode of the bulb is in contact with the first leaf conductor while a positive electrode of the bulb is in contact with the second leaf conductor. The first leaf conductor may be intentionally bent so as to be in contact with the second leaf conductor, rendering the first and second leaf conductors in a short circuit. A fire might occur as a result of such a short circuit.

SUMMARY OF THE INVENTION

The primary objective of this invention is to provide a socket including a bottom and an internal surface. A first slot and a second slot are defined in the bottom of the socket. An annular groove and a vertical groove are defined in the internal surface of the socket. An annular positioner includes on an internal surface a thread for engagement with a thread formed on a bulb. The annular positioner includes two halves joined together by means of a hinge which functions as a ridge when the halves are closed together. A flange is formed on an external surface of each of the halves of the annular positioner. The flanges make an annular flange when the halves are closed together. The annular flange is receivable in the annular groove for retaining the annular positioner in the socket. The ridge is receivable in the vertical groove for keeping the annular positioner from rotation relative to the socket. The annular positioner defines an opening. A first leaf conductor includes a lower portion and an upper portion projecting from the lower portion by an obtuse angle. A second leaf conductor includes a lower portion and an upper portion projecting from the lower portion by a right angle. The first leaf conductor is insertable through the first slot while the second leaf conductor is insertable through the second slot. As the upper portion of the first leaf conductor projects towards the opening defined in the annular positioner, the upper portion of the first leaf conductor is easily insertable through the opening defined in the annular positioner so that an upper tip of the first leaf conductor is retained between the socket and the annular positioner.

DETAILED DESCRIPTION OF THE PREFERRED EMBODIMENT

Figure 1:
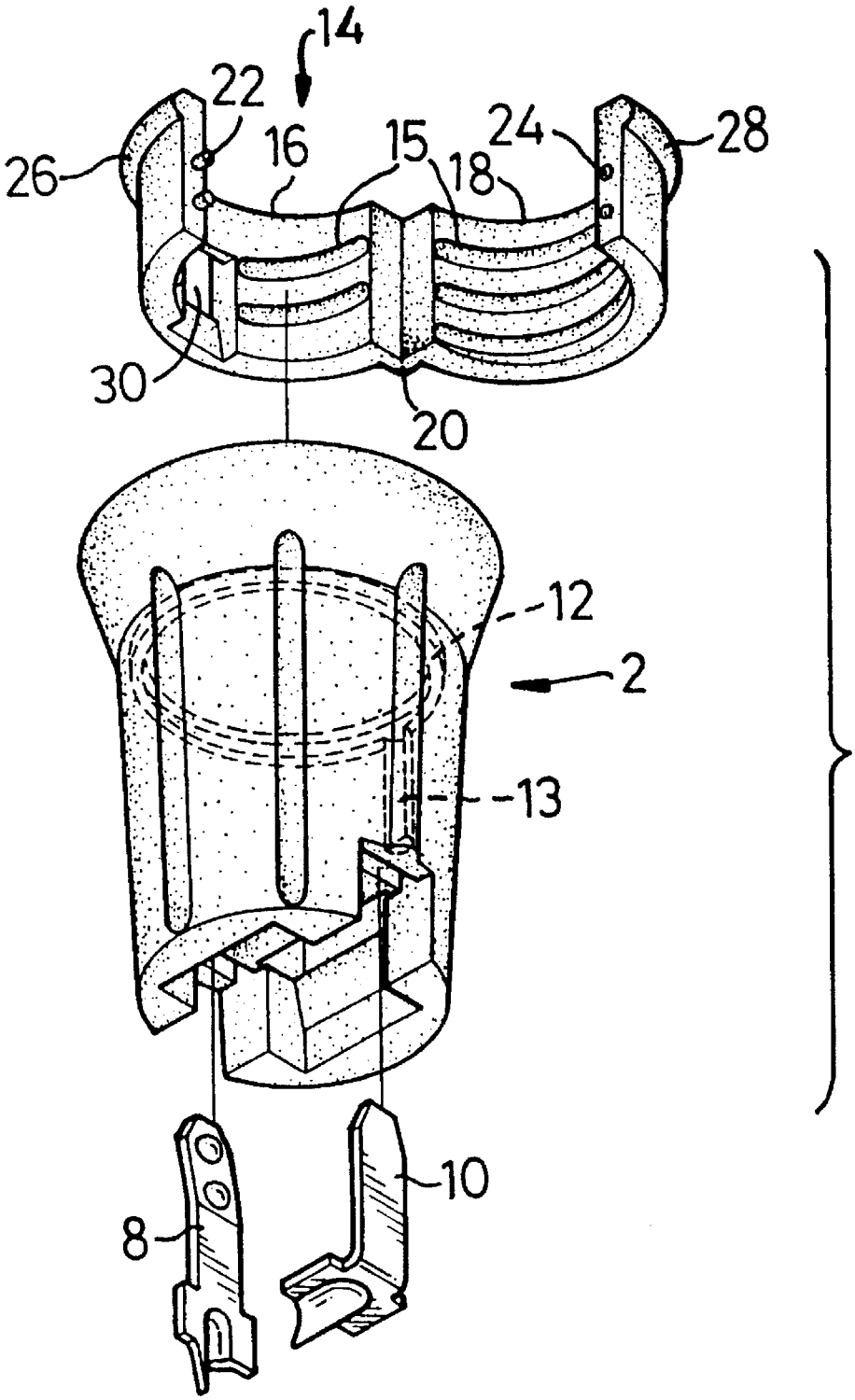
FIG. 1 is an exploded view of the preferred embodiment of a socket according to this invention.
Figure 2:
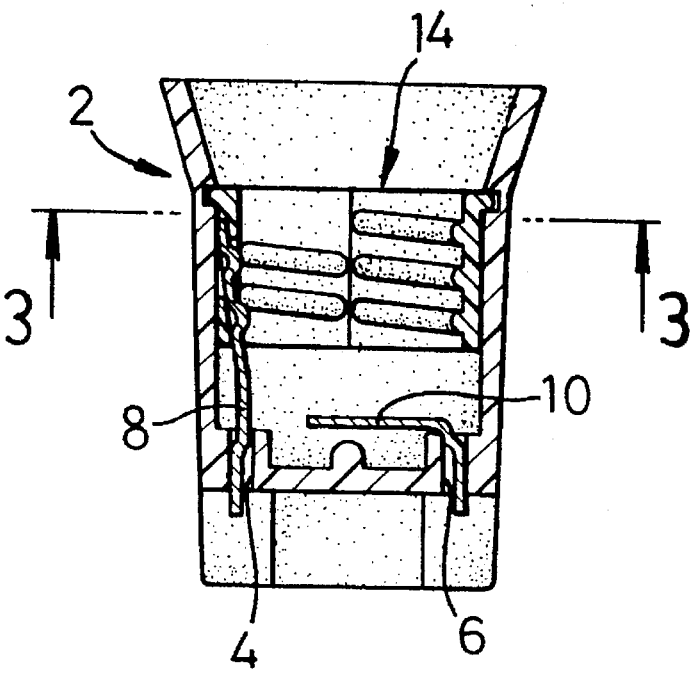
FIG. 2 is a horizontal cross-sectional view of the socket as shown in FIG. 1.
Figure 3:
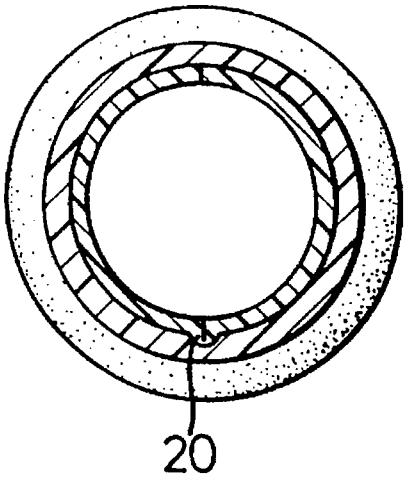
FIG. 3 is a cross-sectional view taken along a line 3—3 in FIG. 2.

FIGS. 1–3 show a socket 2 with a first slot 4 and a second slot 6 both defined in a bottom thereof. A first leaf conductor 8 includes a lower portion and an upper portion projecting from the lower portion by an obtuse angle. A second leaf conductor 10 includes a lower portion and an upper portion projecting from the lower portion by a right angle. The socket 2 will not be described in detail as it is similar to conventional sockets except for an annular groove 12 and a vertical groove 13 both defined in an internal surface thereof.

A positioner 14 is an annular element with a thread 15 formed on an internal surface thereof. The positioner 14 includes a first half 16 and a second half 18. The first half 16 and the second half 18 are formed integrally by means of a hinge 20 in the form of a thin strip. The hinge 20 will function as a ridge as the first half 16 and the second half 18 are closed together. Two pegs 22 are formed on a free edge of the first half 16 while two holes 24 are defined in a free edge of the second half 18. The pegs 22 are receivable in the holes 24 for assembling the first half 16 and the second half 18 into an annular element. A first flange 26 is formed on an external surface of the first half 16 while a second flange 28 is formed on an external surface of the second half 18. The first flange 26 and the second flange 28 make an annular flange when the first half 16 and the second half 18 are closed together. An opening 30 is defined in the first half.

The positioner 14 is retainable in the socket 2 with the first flange 26 and the second flange 28 receivable in the annular groove 12. The positioner 14 is not rotatable relative to the socket 2 as the ridge 20 is receivable in the vertical groove 13.

The first leaf conductor 8 is insertable through the slot 4. As the upper portion of the first leaf conductor 8 projects from the lower portion of the first leaf conductor 8 towards the opening 30, the upper portion of the first leaf conductor 8 is easily insertable into the opening 30 so that an upper tip of the first leaf conductor 8 is retained between the socket 2 and the positioner 14. Thus, the first leaf conductor 8 will not be unintentionally bent when a bulb (not shown) is engaged with the socket 2.

The preferred embodiment of this invention is described in detail for the purpose of illustration, not limitation. The scope of this invention is defined only by means of the appended claims.

What I claim as my invention is:

1. A socket assembly comprising:

a socket including a bottom, two slots defined in the bottom and a groove defined in an internal surface;

an annular positioner including an opening defined therein and a ridge formed on an external surface so that said ridge is received in said groove when the annular positioner is received in the socket to restrain rotation of the annular positioner with respect to the socket;

two leaf conductors correspondingly inserted through the slots, one of said leaf conductors including an upper tip inserted through the opening to be retained between the socket and the annular position to prevent bending thereof and engagement between said leaf conductors when a bulb is received in the socket.

2. A socket according to claim 1 including a thread formed on an internal surface of the annular positioner, wherein the thread is engageable with a thread formed on a bulb.

3. A socket according to claim 1 including at least one annular flange formed on an external surface of the annular positioner and at least one annular groove defined in an internal surface of the socket, wherein the annular flange is receivable in the annular groove for retaining the annular positioner in the socket.

4. A socket according to claim 1 wherein the first leaf conductor includes a lower portion and an upper portion projecting from the lower portion by an obtuse angle.

5. A socket according to claim 1 wherein the annular positioner includes a first half in which the opening is defined, a second half and a hinge for integrally connecting the first half with the second half.

6. A socket according to claim 5 including at least one peg formed on a free edge of the first half and a corresponding number of holes defined in a free edge of the second half so that the peg is receivable in the hole.

7. A socket according to claim 5 including a first flange formed on an external surface of the first half, a second flange formed on an external surface of the second half, an annular groove defined in an internal surface of the socket, so that the first and second flanges make the annular flange when the first and second halves are closed together, wherein the annular flange is receivable in the annular groove for retaining the annular positioner in the socket.

8. A socket according to claim 5 wherein the hinge functions as a ridge when the first and second halves are closed together, wherein the socket defines a vertical groove in an internal surface, wherein the ridge is receivable in the vertical groove for keeping the annular positioner from rotation relative to the socket.

9. A socket comprising a bottom defining a first slot and a second slot, a first leaf conductor insertable through the first slot, a second leaf conductor insertable through the second slot and an annular positioner defining an opening, wherein the annular positioner is secured in the socket, wherein the first leaf conductor includes an upper tip insertable through the opening so as to be retained between the socket and the annular positioner so that the first leaf conductor will not be unintentionally bent and accordingly engaged with the second leaf conductor when a bulb is received in the socket.

10. A socket according to claim 9 including a thread formed on an internal surface of the annular positioner, wherein the thread is engageable with a thread formed on a bulb.

11. A socket according to claim 9 including at least one annular flange formed on an external surface of the annular positioner and at least one annular groove defined in an internal surface of the socket, wherein the annular flange is receivable in the annular groove for retaining the annular positioner in the socket.

12. A socket according to claim 9 wherein the first leaf conductor includes a lower portion and an upper portion projecting from the lower portion by an obtuse angle.

13. A socket according to claim 9 wherein the annular positioner includes a first half in which the opening is defined, a second half and a hinge for integrally connecting the first half with the second half.

14. A socket according to claim 13 including at least one peg formed on a free edge of the first half and a corresponding number of holes defined in a free edge of the second half so that the peg is receivable in the hole.

15. A socket according to claim 13 including a first flange formed on an external surface of the first half, a second flange formed on an external surface of the second half, an annular groove defined in an internal surface of the socket, so that the first and second flanges make the annular flange when the first and second halves are closed together, wherein the annular flange is receivable in the annular groove for retaining the annular positioner in the socket.

16. A socket according to claim 13 wherein the hinge functions as a ridge when the first and second halves are closed together, wherein the socket defines a vertical groove in an internal surface, wherein the ridge is receivable in the vertical groove for keeping the annular positioner from rotation relative to the socket.

* * * * *

UNITED STATES PATENT AND TRADEMARK OFFICE

CERTIFICATE OF CORRECTION

PATENT NO. : 5,518,425

DATED : May 21, 1996

INVENTOR(S) : George Tsai

It is certified that error appears in the above-indentified patent and that said Letters Patent is hereby corrected as shown below:

Claim 1 Line 60 Column 2 "position" should read --positioner--.

Signed and Sealed this

Twenty-second Day of July, 1997

Bruce Lehman

*Attest:*

BRUCE LEHMAN

*Attesting Officer*

*Commissioner of Patents and Trademarks*